US008204269B2

(12) United States Patent
Sahyoun

(10) Patent No.: US 8,204,269 B2
(45) Date of Patent: Jun. 19, 2012

(54) LOW PROFILE AUDIO SPEAKER WITH MINIMIZATION OF VOICE COIL WOBBLE, PROTECTION AND COOLING

(76) Inventor: Joseph Y. Sahyoun, Redwood City, CA (US)

( * ) Notice: Subject to any disclaimer, the term of this patent is extended or adjusted under 35 U.S.C. 154(b) by 858 days.

(21) Appl. No.: 12/221,992

(22) Filed: Aug. 8, 2008

(65) Prior Publication Data

US 2010/0303278 A1 Dec. 2, 2010

(51) Int. Cl.
*H04R 9/06* (2006.01)

(52) U.S. Cl. ..... 381/398

(58) Field of Classification Search ..... 381/398
See application file for complete search history.

(56) References Cited

U.S. PATENT DOCUMENTS

| | | | |
|---|---|---|---|
| 2,231,479 | A | 2/1941 | Perry |
| 2,234,007 | A | 3/1941 | Olson et al. |
| 2,269,284 | A | 1/1942 | Olson |
| 3,684,052 | A | 8/1972 | Sotome |
| 4,207,963 | A | 6/1980 | Klasco |
| 4,228,327 | A | 10/1980 | Sawafuji |
| 4,477,699 | A | 10/1984 | Wada et al. |
| 4,517,416 | A | 5/1985 | Goossens |
| 4,567,327 | A | 1/1986 | Goossens et al. |
| 5,143,169 | A | 9/1992 | Ziegenberg et al. |
| 5,323,469 | A | 6/1994 | Scholz |
| 5,748,759 | A | 5/1998 | Croft et al. |
| 5,883,967 | A | 3/1999 | House |
| 5,933,512 | A | 8/1999 | Tamura |
| 6,160,898 | A | 12/2000 | Bachmann et al. |
| 6,173,065 | B1 | 1/2001 | Lin |
| 6,236,733 | B1 | 5/2001 | Kato et al. |
| 6,259,800 | B1 | 7/2001 | Tagami |
| 6,385,327 | B1 | 5/2002 | D'Hoogh |
| 6,445,803 | B1 | 9/2002 | Boon et al. |
| 6,496,590 | B2 | 12/2002 | Proni |
| 6,590,990 | B2 | 7/2003 | Abe et al. |
| 6,658,129 | B2 | 12/2003 | D'Hoogh |
| 6,672,423 | B2 | 1/2004 | Kato |
| 6,862,361 | B2 | 3/2005 | James et al. |
| 7,197,154 | B2 | 3/2007 | Sahyoun |
| 7,225,895 | B2 | 6/2007 | Sahyoun |

(Continued)

FOREIGN PATENT DOCUMENTS

DE 30 20 146 12/1981

(Continued)

OTHER PUBLICATIONS

Search Report and Written Opinion in PCT/US09/04479, dated Dec. 10, 2009.

(Continued)

*Primary Examiner* — Alexander Ghyka
*Assistant Examiner* — Stanetta Isaac
(74) *Attorney, Agent, or Firm* — Allston L. Jones; Peters Verny, LLP

(57) ABSTRACT

A low profile speaker that is designed to substantially eliminate wobble of the bobbin and voice coil during operation with two different electromagnetic motor designs. In each design there is an added feature to of a downward extension of the outer edge of the cone that bottoms out on the bottom surface of the frame before the bottom edge of the bobbin strikes the bottom of the air gap thus preventing damage to the bobbin and voice coil when the voice coil is overdriven downward. Additionally, there are two different bobbin and voice coil cooling feature for use with electromagnetic motors that utilize a Tyoke construction.

21 Claims, 9 Drawing Sheets

U.S. PATENT DOCUMENTS

| | | | |
|---|---|---|---|
| 7,360,626 | B2 | 4/2008 | Sahyoun |
| 2002/0094105 | A1 | 7/2002 | Boniface |
| 2005/0078849 | A1 | 4/2005 | Funahashi et al. |
| 2006/0274914 | A1 | 12/2006 | Horigome et al. |
| 2006/0285718 | A1 | 12/2006 | Funahashi |

FOREIGN PATENT DOCUMENTS

| | | |
|---|---|---|
| DE | 39 23 189 | 1/1991 |
| WO | WO 97/46047 | 12/1997 |

OTHER PUBLICATIONS

Examiner's Action in U.S. Appl. No. 10/646,548, mailed Jun. 27, 2005.

Examiner's Action in U.S. Appl. No. 10/753,278, mailed Feb. 24, 2006.

Examiner's Action in U.S. Appl. No. 10/753,278, mailed Nov. 9, 2006.

Search Report in PCT/US03/26387, dated Feb. 27, 2004.

Search Report in PCT/US05/04228, dated Mar. 7, 2006.

Search Report in PCT/US05/17304, dated Oct. 23, 2006.

LOW PROFILE AUDIO SPEAKER WITH MINIMIZATION OF VOICE COIL WOBBLE, PROTECTION AND COOLING

BACKGROUND OF THE INVENTION

1. Field of the Invention

This invention relates to audio speakers and in particular to the construction of audio speakers that have minimization of wobble of the voice coil bobbin and all moving parts during operation, minimization of damage to the voice coil and bobbin when the speaker is over driven and cooling of the voice coil and bobbin during operation.

2. Description of the Related Art

A goal of sound reproduction equipment is to provide a life-like sound quality to the listener. Life-like sound quality is understood to be best achieved when a sound system, including the speakers, have a flat frequency response curve throughout the range of sound frequencies audible to the human ear, generally 20 to 20,000 Hz. A normal speaker cabinet has an electro magnetically driven speaker cone sealed to an opening in the wall of a sealed, port vented, and passive tuned cabinet.

As TV technology evolved into thin cabinet designs, this pressured speaker technology to do the same hence the need for shallow speaker systems. The need for shallow, low profile speakers are not limited to meeting the home audio demand. Such low profile speakers also have application in cars, boats, airplanes and other locations that will benefit from the depth reduction without taxing the sound pressure level. In cars for example, the available mounting depth behind the door panel is much less than the minimum height of conventional speakers. In order to use conventional speakers in such locations, it is nearly always necessary to use a raised grill cover over the speaker since it necessary to have a portion of the speaker height extend above the surface of the door panel into the passenger compartment.

In addition to mounting depth reduction, the low profile speaker of the present invention offers weight reduction as well. With energy costs on the rise, this comes in handy to reduce operating cost while the speaker is in motion. A typical design of an 8 Inch woofer with conventional technology shows a weight of 18 lbs. while a low profile woofer of the same size could weigh about 6 lbs. This weight benefit is substantial when the woofer size is greater such as 15 inch. A 15 inch low profile speaker of the present invention weighs about 10 lbs. with a mounting depth of 3 inches while a conventional 15 inch speaker weighs about 30 to 40 lbs. with a mounting depth of 8 to 9 inches. Carrying such a dead weight around in a motor vehicle simply increases gas guzzling.

For the most part, subwoofer construction has followed conventional technology—the use of an oscillating diaphragm that responds to a varying magnetic field developed by an applied audio signal. That varying magnetic field causes the diaphragm to be attracted and repelled to and from the intermediate position where the diaphragm rests when no audio signal is applied to the speaker. For the most part, current speaker technology uses a loudspeaker made of a rigid diaphragm, or "cone", suspended within a speaker frame, or "basket" around the outer edge with a flexible membrane, or "surround". This membrane allows the cone to move inward and outward when driven by a varying magnetic field resulting from the application of an audio, or "music", signal applied to the speaker.

Over the years speakers have been designed with a conventional structure—a cone connected to the outer part to a speaker frame, or basket, through a flexible membrane (surround). To develop a back-pressure wave and to control axial movement of the cone, designers installed a secondary part called a "spider" that also connects the inner part of the cone to the speaker frame. Almost all spider materials used are made of cloth that has been treated and pressed in a heated die to form the shape of the spider that was sought. Conventional speakers require a huge mounting depth that render them useless in shallow spaces where consumers now wish to place speakers. For example, a conventional 10 inch diameter speaker, with an excursion of ±1 inch requires a mounting depth of at least 7 inches. Moreover 12 inch diameter conventional speakers requires a mounting depth of at least 7 to 8 inches. Hence conventional speakers clearly will not fit in shallow spaces, such as walls where the mounting depth is limited to about 3.5 inches, or less, unless a smaller diameter conventional speaker is used. Thus, consumer demand has created a need that conventional speakers can not meet and still provide the performance desired by the consumer. Therefore there is a need to develop loudspeakers that have a large piston area with a minimum mounting depth. Low profile speakers designed using the present invention meet that need.

Conventional speakers have many weaknesses that have become much more evident in longer stroke woofers. Since conventional speakers rely upon the glue ring connection of the cone with the voice coil bobbin and spider, that connection is subjected to bending moments that collapse the glue ring during downward (inner stroke movements) and flare outward the glue ring during outward strokes. Additionally, the structure of conventional speakers promotes harmonically related bending of the cone during inward/outward strokes that fatigues the inner portion of the cone and leads into what is known as a neck-cone failure. This typically, partially or completely, breaks the cone into two cones around the neck area. Prior to that type of failure the cone is known to have a cycle of life during which the cone is breaking down and during the slow breakdown of the cone, distortion increases that becomes increasingly unpleasant for the listener. Further conventional speakers have not been designed to maintain the inner suspension (spider) parallel to the outer suspension (surround) as the cone is driven by the voice coil. The spider and surround are each rigidly connected to the inner and outer edges of the cone, respectively, and any misalignment of those connections and/or variations in the material of the spider, surround and cone around the speaker cause the cone to twist in opposite directions as it is driven inward and outward, with the amount of that twisting increasing as the stroke of the voice coil bobbin increases in each direction. This connection configuration can only compromise such a structure as the cone bends as it moves and causes twisting or spiraling movement.

Another problem that results in reduced audio performance of conventional speakers is wobble of the voice coil during operation of the speaker. Current speaker design structures suffer from several compromising parts that play a major role in producing a high level of harmonic distortion. As it has been a trend in speaker design to get the most output from a speaker opening, they resort to increasing the excursion in order to increase the amount air displacement. What previously was a 0.3 inch high voice coil are now a 1.5 inch, and as high as 2 inch, winding height of the voice coil. These increased height voice coils thus move in excess of 1 inch each way, inward and outward. Often speakers can be found where the movement is as much as 1.5 inches each way. During extreme excursions, these woofers are pushed by these long voice coils that weigh three times as much as in previous designs. The motor (voice coil) is connected to the cone and the spider in what is known as the inner suspension.

The cone is a stiff component relative to the suspension and surround, extending outward (generally) and connects the inner suspension to an outer larger diameter suspension. The combination of spider, cone, outer surround, and voice coil bobbin are interconnected to oscillate axially. When an audio signal with a frequency F is sent to the voice coil it develops a variable magnetic field that interacts with the fixed magnetic field produced by the magnet assembly to produce an oscillating force. During these oscillations, the moving parts are subjected to a uniform internal pressure due to the compressed air in the enclosure and tension developed by the spider and surround. The spider and surround each have some manufacturing offset that tend to be apparent during long strokes as the moving elements will start to wobble. The cone typically is made of processed materials (e.g., pressed paper) thus the cone also possesses a non linear stiffness that leads to another offset. The combination of these offsets leads to wobble of the voice coil bobbin within the air gap of the magnet assembly.

That wobble can distort the sound produced in varying degrees as the voice coil travels inward and outward in many ways, e.g., distorting the shape of the cone. Wobble can also reduce the useful life of a speaker by repeatedly over stressing the cone and other components that eventually results in failure of the component, e.g., a crack or a tear in the cone, partial separation of the cone and surround, etc. Wobble can even result in total failure of the speaker. This can occur if the voice coil is over driven outward with the lower edge of the voice coil bobbin coming completely out of the air gap of the magnet assembly with the wobble shifting the lower edge of the voice coil bobbin so that it is no longer aligned with the slot in the magnet assembly. The bottom edge of the voice coil bobbin then hangs up on the top of the magnet assembly as the tension in the spider and surround pull the cone and attached voice coil bobbin downward when the lower end of the voice coil bobbin does not reenter the magnet assembly. Once hung up on the top of the magnet assembly the speaker can no longer move regardless of whatever drive signal is applied to the voice coil since the voice coil is no longer in the magnetic field of the magnet assembly so the drive signal does not interact with the magnetic field, i.e., no signal when applied to the voice coil will be able to move the voice coil bobbin.

Another problem that has occurred when a speaker has been over driven in a downward stroke is the bobbin, and possibly the voice coil as well, being damaged when the bottom edge of the bobbin strikes the bottom of the air gap in the magnet assembly. When this occurs, several different things may occur. The bobbin bottom edge can be bent so that the bobbin scrapes the interior of the air gap on the up stroke, the bobbin can be bent out of round which can not only cause scraping but also create serious wobble of the bobbin. Any impeding of the movement of the bobbin may cause distortion in the sound produced by the speaker as well as overheating of the voice coil which can produce total failure of the speaker. The bobbin striking the bottom of the air gap can also cause compression of some of the windings of the voice coil that will distort the sound produced by the speaker, and could even break one or more windings of the voice coil which will cause total failure of the speaker.

In a conventional speaker, the cone is suspended by an outer surround and an inner surround. The outer surround is typically connected to the largest diameter of the cone. The inner surround is connected to smallest ring of the cone. This means that the spider (typically used on the inner surround) will have an inner contact ring with the cone of a typical 2 inch diameter (on a 10 inch woofer, and no larger than 4 inch on a 12 and 15 inch woofer). These inner rings are suppose to control lateral movement so that the cone/voice coil assembly does not wobble. Since the guiding ring in these conventional speakers (spider contact ring with the cone) are small rings, the wobble is a serious reason for failures. Over 20% of woofer failures is attributed to wobble that led the voice coil to rub on the pole piece (the Tyoke shaped metal piece). In analyzing these failures, the voice coil tends to wobble and rub on the Tyoke until it comes apart. Often these failures show that the voice coil jumped on top of the Tyoke. Designers have resorted to the use of 2 spiders (inner and outer) to reduce these wobbles.

SUMMARY OF THE INVENTION

The present invention includes several embodiments of a low profile audio speaker include minimization of wobble of the voice coil bobbin and all moving parts during operation, minimization of damage to the voice coil and bobbin when the speaker is over driven and cooling of the voice coil and bobbin during operation.

Each of the embodiments of the present invention include an audio speaker that includes a low profile frame with a bottom surface and side that extends upward therefrom terminating in an exterior edge of a uniform first height above the bottom surface and defining an exterior edge with the side including an interior mounting point a selected distance between the bottom surface and the exterior edge. Mounted to the bottom surface of the frame is a motor including a magnet assembly with a defined air gap and a bobbin with a voice coil wound thereon in the air gap. A cone having an inner edge defining a centrally located hole sized to fit around, and attach to, the outer surface of the bobbin above the magnet assembly and from the inner edge the cone radiates outward a selected distance then turning downward in a downward extension spaced apart from the side of the frame with the downward extension defining a circle that is larger than the outer extent of the magnet assembly with the outer edge of the cone being at the end of the downward extension. Additionally there is a first flexible suspension connected between the interior mounting point of the frame and the downward extension of the cone, plus a second flexible suspension connected between the exterior edge of the frame and a point on the top surface of the cone before the cone turned downward to form the downward extension.

In a first embodiment the downward extension defines a connection point thereon for receiving the first flexible suspension that is opposite the interior mounting point of the frame when the voice coil is not energized.

In a second embodiment the outer edge of the cone is a selected distance below the connection point with the overall length of the downward extension being long enough so that the outer edge of the cone strikes the interior bottom surface of the frame before the bobbin strikes a bottom of the air gap in the magnet assembly on a downstroke to protect the bobbin from possible damage.

In a third embodiment the connection point on the downward extension is on the outer edge of the cone.

In a fourth embodiment a selected portion of the top surface of the cone is higher than the inner edge of the cone and the speaker further includes a dust cover that is sized and shaped to span the bobbin with an outer edge of the dust cover affixed to the selected portion of the top surface of the cone. And in a fifth embodiment the dust cover is also attached to the top of the bobbin. Further, in a sixth embodiment the top surface of the cone includes a raised centering bead encircling and spaced apart from the inner edge of the cone for placement of the dust cover. The seventh embodiment is an alternative to the sixth embodiment with the selected portion of the top of the cone including a first plateau closest to the inner edge of the cone sized to receive the outer edge of the dust cover with a second plateau farthest from the inner edge of the cone that is higher than the first plateau with the edge between the first and second plateaus forming a centering edge for placement of the dust cover on the second plateau.

In an eighth embodiment the second flexible suspension is a typical surround that is connected between the exterior edge of the frame and a point on the top of the cone substantially above the point at which the cone turns downward to form the downward extension, or an oversized surround that is connected between the exterior edge of the frame and the top surface of the cone closer to the inner edge of the cone than the point where the cone turns downward in the downward extension.

In a ninth embodiment the speaker includes a third flexible suspension connected between the downward extension of the cone and a top surface of the magnet assembly.

The tenth and eleventh embodiments of the invention each provide a different cooling configuration. In each there is a dust cover sized and shaped to span the bobbin with an outer edge thereof affixed to the top surface of the cone, and each the magnet assembly includes:

- a ferro magnetic Tyoke with an upward extending center pole portion having an outward extending flange from the bottom thereof with the center pole portion having a diameter that is smaller than the diameter of the bobbin with the outer edge of the outward extending flange having a diameter that is larger than the diameter of the bobbin and smaller than the diameter of the downward extension of the cone;
- a flat doughnut shaped magnet having a circular center hole having a diameter that is larger than the diameter of the bobbin with the magnet affixed to the outward extending flange and centered around the center pole of the Tyoke providing the air gap between the magnet and the center pole; and
- a ferro magnetic doughnut shaped top plate having a circular center hole having a diameter that is larger than the diameter of the bobbin and smaller than the diameter of the center hole of the magnet with the top plate affixed to the magnet and centered around the center pole of said Tyoke.

Additionally, in both embodiments, the Tyoke has a plurality of air passages defined between a top and outer side thereof opening into the air gap.

In the tenth embodiment, the Tyoke also has a plurality of air passages through the outward extending flange between the bottom of the air gap and the bottom of the speaker so that on the downstroke of the bobbin air below the dust cover is forced through the air passages in the top of the Tyoke into the air gap and out through the air passages in the outward extending flange to cool the voice coil as air passes through the air gap.

Whereas in the eleventh embodiment, wherein top plate has a plurality of air passages defined through an inner edge thereof in communication with the air gap so that on the downstroke of the bobbin air below the dust cover is forced through the air passages in the top of the Tyoke into the air gap and out through the air passages in the top plate to cool the voice coil and bobbin as air passes through the air gap.

An alternative for both of the tenth and eleventh embodiments the center pole of said Tyoke can be solid with a cup shape in a top surface thereof with the plurality of air passages being in the shape of slots through a top portion of the cup shape with this configuration causing the entire volume of air beneath the dust cap to be forced in and out of the combination of the slots in the Tyoke center pole to cool the voice coil and bobbin.

Optionally in the eleventh embodiment the top plate can have an upward sloping inner edge spaced apart from the outer surface of cup shape of the center pole of the Tyoke to further improve the communication of the flow of air through the air gap.

In the configurations of the eleventh embodiment, the air passages in the Tyoke and the top plate reduce the formation of eddy currents that rotate in the magnetic gap and thus reduce eddy current losses that otherwise oppose the motion of the voice coil in the air gap and cause the amount of energy to move the cone and voice coil to be greater to receive the same response from the speaker.

In a twelfth embodiment of the present invention the motor is circular with flat top and bottom surfaces wherein the magnet assembly includes:

- a ferro magnetic circular enclosure having a diameter that is larger than the diameter of the bobbin and smaller than the diameter of the downward extension with a cross-section that is substantially "U" shaped with a flat bottom, sides that extend upward substantially perpendicularly from the bottom and a top edge that turns inward forming a small lip that is parallel to the flat bottom forming an opening into the enclosure with the inner edge of said lip having a diameter that is slightly smaller than the diameter of the enclosure and slightly larger than the diameter of the bobbin;
- a flat circular magnet centrally mounted within the enclosure having a diameter that is smaller than the diameter of the bobbin and a height that is substantially equal to the internal height of the enclosure formed between the inner surface of the bottom of the enclosure and the inside surface of the lip forming the air gap between the magnet and the vertical sides of the enclosure; and
- a ferro magnetic circular flat top plate centered on top the magnet between the ends of the lip of enclosure having a diameter that is smaller than the diameter of the bobbin and greater than or equal to the diameter of the magnet with a space between the lip of the enclosure and the top plate disposed to receive the bottom end of the bobbin and voice coil wound thereon.

Additionally in the twelfth embodiment the inner edge of the cone terminates in a short mounting lip having an upward facing top side and the speaker further includes a flat dust cover sized and shaped fit on said mounting lip of the cone.

An option for the twelfth embodiment is that each of the ferro magnetic circular enclosure, flat circular magnet and ferro magnetic circular flat top plate has a hole defined centrally therethrough that provides an easy centering guide for assembly of the motor.

DETAILED DESCRIPTION

FIGS. 1 through 8D illustrate a variety of low profile, shallow speaker embodiments of the present invention that are mountable in shallow, small clearance locations. To simplify the understanding of each of these embodiments, elements in the various figures that are the same have been given the same reference number. Those elements that are modified and which perform the same or similar function have the same number with the first use without a prime and each variation one or more primes have been added to the reference number.

Figure 1:
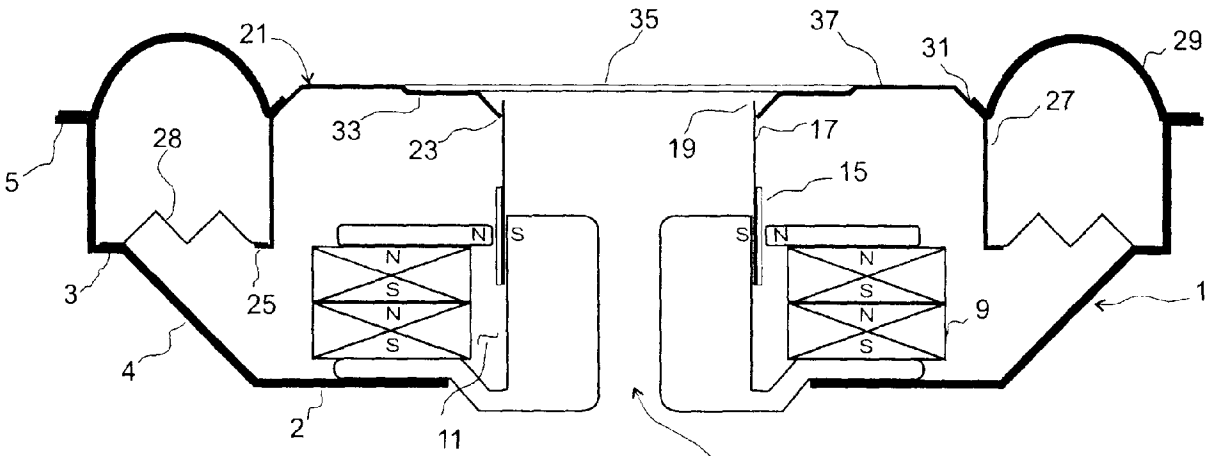
FIG. 1 is a cross-sectional center slice of a first embodiment low profile shallow speaker of the present invention without the dust cap attached to the top of the voice coil bobbin.

FIG. 1 shows a simplified cross-sectional slice of a first embodiment low profile speaker design of the present invention. For purposes of illustration the speaker is in a static position without a signal having been applied to excite the speaker. Cross-sectioning has been omitted to minimize confusion. Included is a low profile frame 1 having an interior bottom surface 2 with a side portion 4 extending upward from, and surrounding, the interior bottom surface. Side portion 4 terminates in an exterior edge 5 of a uniform height above the interior bottom surface 2 with the exterior edge 5 defining an opening into frame 1 having a selected size and shape. Side portion 4 also includes an interior side mounting point 3 therearound a fixed distance between the interior bottom surface 2 and the exterior edge 5.

The speaker of FIG. 1 also includes a motor 7 connected to the interior of bottom surface 2. Motor 7 includes a magnet assembly 9 with an air gap 11 formed therein and a bobbin 17 with a voice coil 15 wound on a first end thereon located in air gap 11, and a second end 19 extending out of air gap 11. Additionally, it can be seen that the portion of magnet assembly 9 that is within frame 1 has a height that is less than the overall height of frame 1.

The embodiment of FIG. 1 also includes a cone 21 having an outer edge and an inner edge, and a top surface and a bottom surface, with the inner edge 23 defining a centrally located hole sized to fit around, and attach to, the outer surface of bobbin 17 below second end 19. From inner edge 23, cone 21 radiates outward a first selected distance at which point a downward extension 27 is formed with the end thereof being outer edge 25 of cone 21. The end of downward extension 27 is opposite interior side mounting point 3 of frame 1 with an inner suspension (shown here as a spider) 28 interconnecting interior side mounting point 3 with the end of downward extension 27. In this view it can be seen that the end of downward extension 27 defines a second size and shape that is smaller than the first size and shape defined by exterior edge 5 of frame 1. For purposes of discussion here the first and second shapes will each be referred to as a circle, however other shapes could be used, e.g., an oval.

Additionally, an outer suspension (shown here as a surround) 29 interconnects the exterior edge 5 of frame 1 with the top surface of cone 21 at point 31 that is substantially above downward extension 27. Cone 21 is also shown having a portion of the top surface 37 that is higher than inner edge 23 thereof and higher than second end 19 of bobbin 17. A dust cover 35 that is sized and shaped to span bobbin 17 above second end 19 thereof with an outer edge affixed to the higher portion 33 of the surface of cone 21 is also shown. In this configuration it can be seen that inner suspension 28 and outer suspension 29 each span substantially the same length gap.

To provide centering of dust cover 35, the higher portion of the top surface of cone 21 has also been formed to includes a first plateau 33 closest to the inner edge 23 to receive the outer edge of dust cover 35 and a second plateau 37 farthest from inner edge 23 that is higher than first plateau 33 with the edge between the first and second plateaus forming a centering edge to center the placement of dust cover 35.

Alternatively to the two plateau configuration, the higher portion of the top surface of cone 21 can be formed with a centering bead at the location of the step between the two plateaus to center dust cover 35 when affixed to cone 21.

Downward extension 27 is between an outer most extent of motor 7 relative to interior bottom surface 2 of frame 1 and side portion 4 of frame 1. Further, the length of downward extension 25 is selected so the end thereof does not come into contact with inner bottom surface 2 of frame 1 when motor 7 is activated and voice coil 15 is drawn into air gap 11 to the maximum extent.

The inclusion of dust cap 35 in the embodiment of FIG. 1 provides added rigidity to the center of cone 21 that minimizes flexing of cone 21 even without direct connection between dust cap 35 and bobbin 17. Therefore, since flexing of cone 21 is a primary contributing factor to wobble of bobbin 17 as voice coil 15 travels into, and out of, air gap 11, the structure of the first embodiment illustrated in FIG. 1 reduces wobble of bobbin 17.

Figure 2:
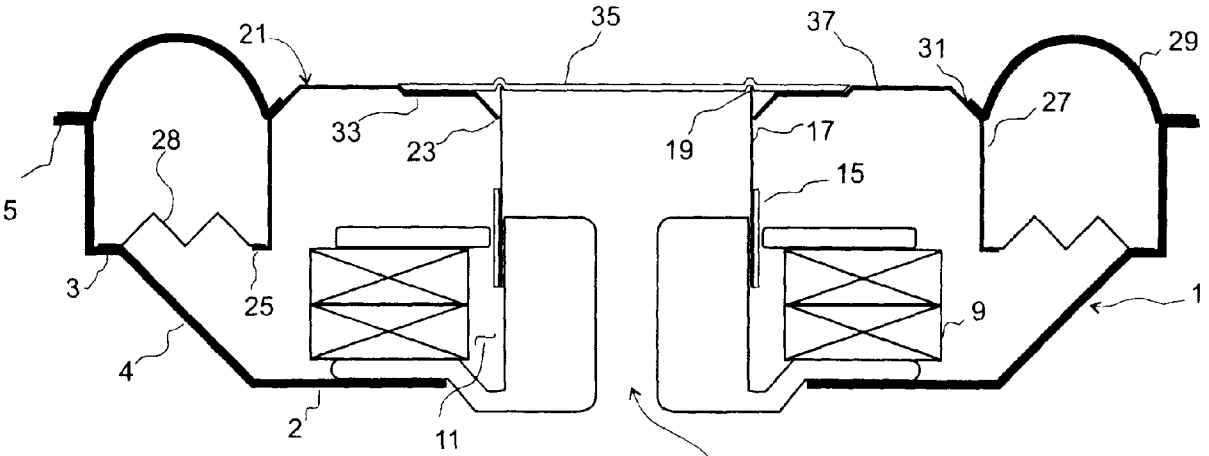
FIG. 2 is a cross-sectional center slice of a second embodiment low profile shallow speaker of the present invention that is similar to that of FIG. 1 with the dust cap attached to the top of the voice coil bobbin.

FIG. 2 shows a simplified cross-sectional slice of a second embodiment low profile speaker design of the present invention that is similar to that of FIG. 1. The difference between the two embodiments is in the design and attachment of the dust cover. Dust cover 35' in this embodiment is formed with a downward facing circular groove 39 that is sized and shaped to receive second end 19 of bobbin 17 for attachment thereto when dust cover 35 is also attached to the top of cone 21. While this view of the low profile speaker still shows the top surface of cone 21 having first and second plateaus 33 and 37, the upper most portion of the top surface of cone 21 could be flat with groove 37 functioning to center dust cover 35'. In this embodiment inner edge 23 of cone 21 is connected to the side of bobbin 17 at a lower point than in the first embodiment so that dust cover 35' can come into contact with second end 19 of bobbin 17 when the speaker is in the static position. The closed triangular space between cone 21, dust cover 35' and bobbin 17 of the second embodiment provides additional anti-wobble control of bobbin 17 as it travels into, and out of, air gap 11 as voice coil 15 is activated compared to that provided by the stiffening of cone 21 by dust cover 35 as in the first embodiment of FIG. 1.

Figure 3:
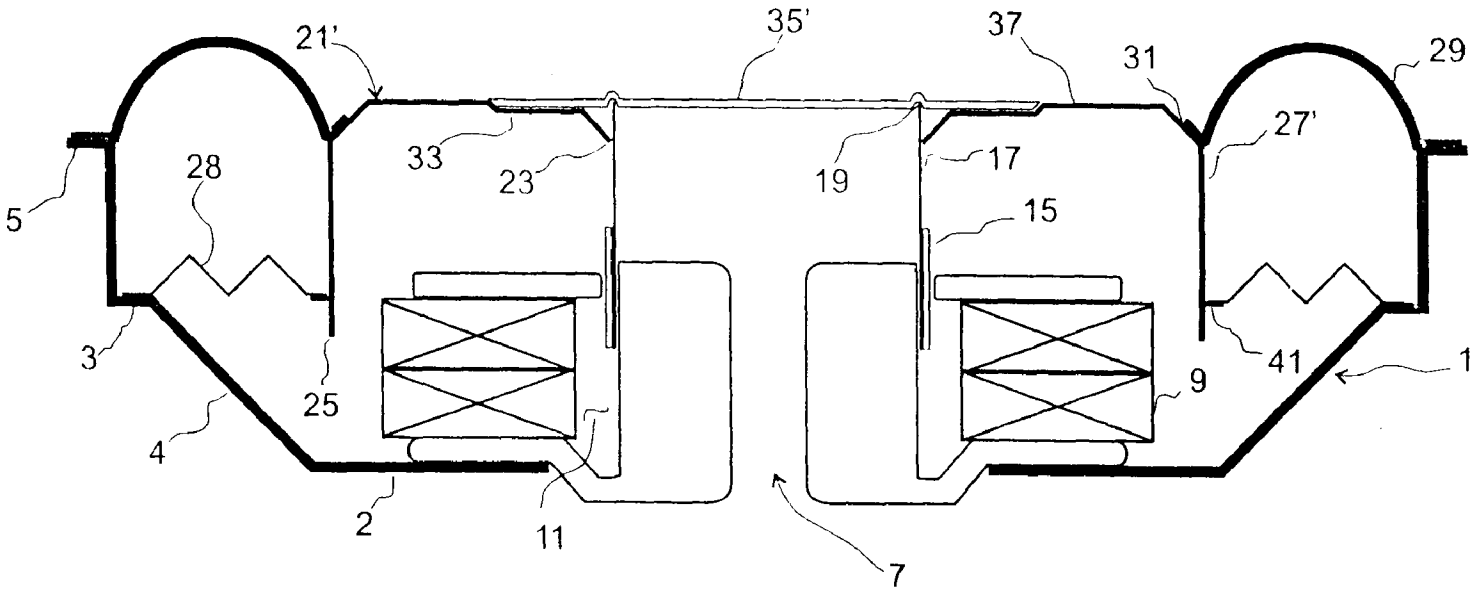
FIG. 3 is a cross-sectional center slice of a third embodiment low profile shallow speaker of the present invention that is similar to that of FIGS. 1 and 2 with an elongated downward extension from the cone.

FIG. 3 is a third embodiment low profile shallow speaker of the present invention that is similar to the second embodiment of FIG. 2. The difference between this embodiment and the second embodiment of FIG. 2 is that downward extension 27' is longer than downward extension 27 with connection point 41 to which inner suspension 28 connects being above outer edge 25 of cone 21'. The portion of downward extension 27' that extends below connection point 41 is introduced as a protection device for voice coil 15, referred to hereinafter as voice coil protection (VCP). If the speaker were over driven sufficiently that would cause voice coil 15 to be drawn into air gap 11 with sufficient power to bottom out, voice coil 15 would be damaged. By selecting the longer length of downward extension 27' so that the bottom end of downward extension 27' strikes interior bottom surface 2 of frame 1 before the first end of bobbin 17, having voice coil 15, bottoms out in air gap 11, damage to voice coil 15 will be averted and the speaker will continue to operate. This feature can be incorporated into all of the various embodiments of the present inventions.

While the voice coil protection (VCP) is only shown in FIG. 3, downward extension 27 in all of the embodiments of the present invention can be replaced with downward extension 27' to provide the same protection to each of the embodiments.

Cone 21 in FIGS. 1 and 2, and cone 21' in FIG. 3 can each be vacuum formed into the shapes shown or any other similar shape. Alternatively, cone 21 or 21' could be formed to only extend from the inner edge 23 that is connected to bobbin 17 to just below the connection point 31 beneath outer suspension 29 with downward projection 27 or 27' an additional piece that is connected to outer suspension 29 and the cone at point 31.

Figure 4:
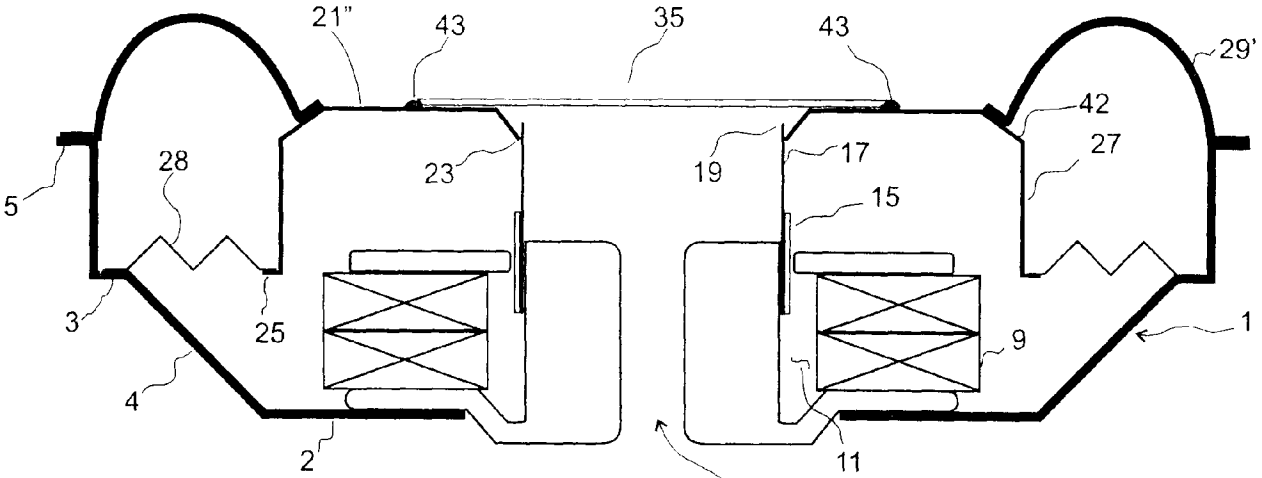
FIG. 4 is a cross-sectional center slice of a fourth embodiment low profile shallow speaker of the present invention without the dust cap attached to the top of the voice coil bobbin that is similar to that of FIG. 1.

FIG. 4 is a fourth embodiment low profile shallow speaker of the present invention that is similar to the first embodiment of FIG. 1. The differences between this embodiment and the first embodiment include cone 21" having a single flat portion that is higher than inner edge 23 with an optional raised circular bead 43 formed thereon for centering the placement of dust cover 35. Additionally, this embodiment includes a larger outer suspension, shown here as surround 29', referred to hereinafter as over-sized surround (OSS). As can be seen in FIG. 4 the inner edge of surround 29' attaches to point 41 on cone 21" which is not directly above downward extension 27, rather it is closer inward toward inner edge 23 of cone 21". In FIG. 4 it can be seen that outer suspension 29' (OSS) spans a wider gap than the gap that is spanned by inner suspension 28.

Figure 5:
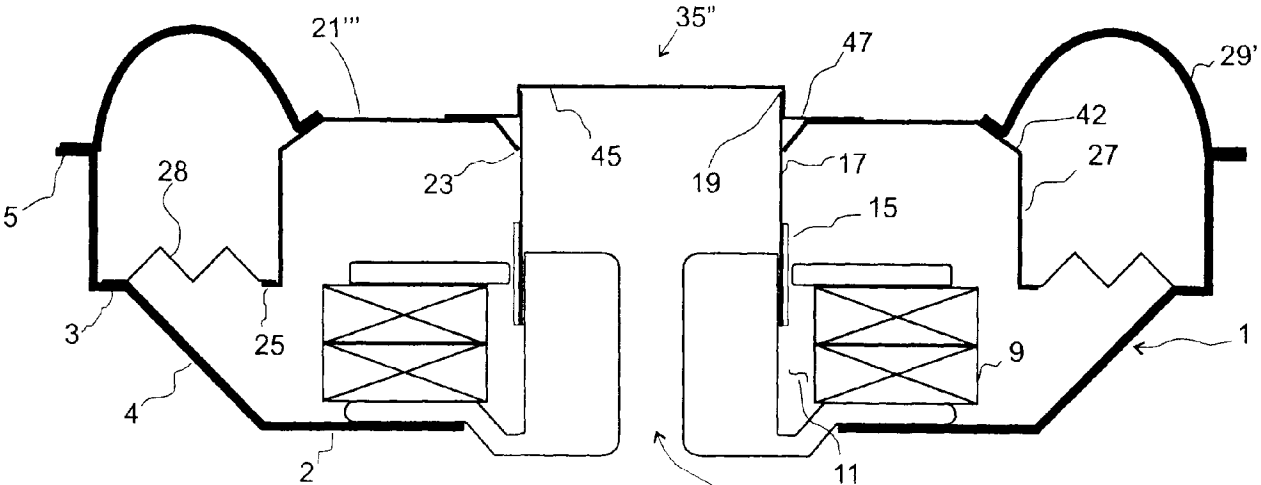
FIG. 5 is a cross-sectional center slice of a fifth embodiment low profile shallow speaker of the present invention that is similar to that of FIG. 2 with the dust cap attached to the top of the voice coil bobbin.

FIG. 5 is a fifth embodiment low profile shallow speaker of the present invention that is similar to the second embodiment of FIG. 2. The differences between this embodiment and the second embodiment is that this embodiment includes cone 21''' having a single flat portion that is higher than inner edge 23. This embodiment also includes a larger outer suspension, shown here as over-sized surround 29' (OSS) as is also shown in FIG. 4. As can be seen in FIG. 5 the inner edge of surround 29' attaches to point 41 on cone 21''' which is not directly above downward extension 27, rather it is closer inward toward inner edge 23 of cone 21'''. In FIG. 5 it can be seen that outer suspension 29' spans a wider gap than the gap that is spanned by inner suspension 28. A third difference from the second embodiment of FIG. 5 is the shape of dust cover 35". Here dust cover 35" has a center cap portion 45 with an outward extending flange 47. Cap portion 45 has an inner diameter that is sized to fit over second end 19 of bobbin 17 where it is glued in place with flange 47 extending outward horizontally for attachment to the flat top portion of cone 21'''. This configuration provides a positive attachment of dust cover 35" to bobbin 17 and creates a triangular region similar to that of FIGS. 2 and 3 between bobbin 17, inner edge 23 of cone 21''' and flange 47 of dust cover 35". That closed triangular region provides additional anti-wobble control of bobbin 17 as it travels into, and out of, air gap 11 as voice coil 15 is activated compared to that provided by the stiffening of cone 21 by dust cover 35 as in the first embodiment of FIG. 1.

In the embodiments of FIGS. 4 and 5, outer OSS suspension 29' is oversized (more than it has to be) resulting in the outer OSS suspension 29' spanning a longer distance than that spanned by inner surround 28 relative to the bottom of frame 1. This results in the radiating diameter of the cone/dust cover combination being smaller than in the embodiments of FIGS. 1 and 2. The use of an outer OSS suspension 29' has application for speakers with a longer stoke of the bobbin and voice coil to minimize strain on the outer suspension. A finite element analysis of the smaller outer surround as in FIGS. 1 and 2 shows that during long inward strokes the material of surround that has a half circle cross-section tends to resist the long stroke. During long inward strokes, the smaller surround experiences the creation of dimples in its shape which increase undesirable wobble. The use of surround with a larger half circle cross-section reduces the formation of dimples while maintaining the desired anti-wobble suspension characteristics.

While FIGS. 4 and 5 each illustrate a low profile speaker with an oversized surround 29', either surround 29 or oversized surround 29' could be used with all embodiments of the current invention.

Figure 6:
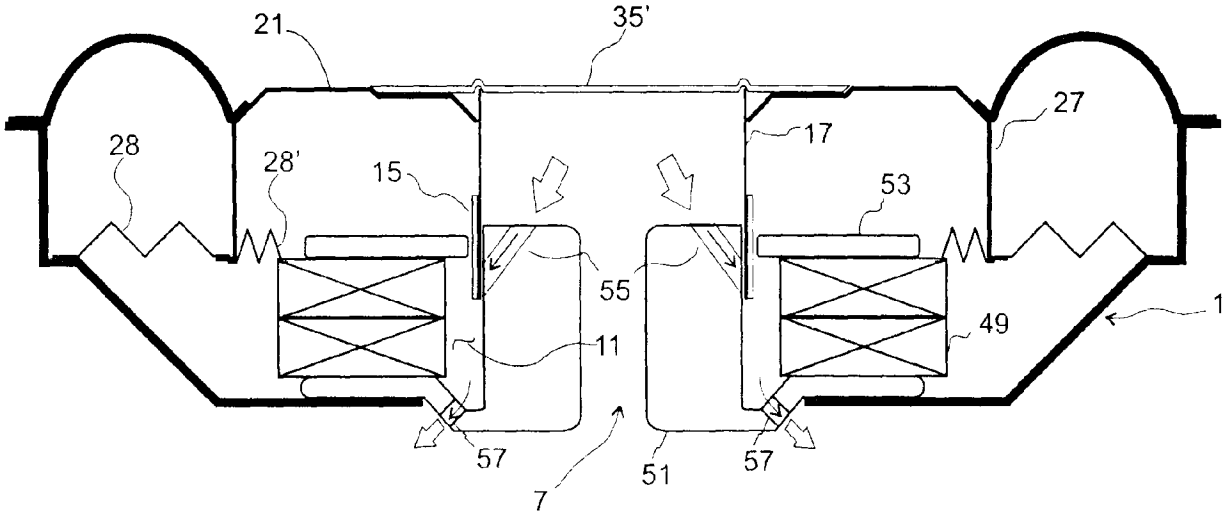
FIG. 6 is a cross-sectional center slice of a low profile shallow speaker of the present invention that is similar to that of FIG. 2 with a first motor cooling configuration.

FIG. 6 illustrates a first cooling configuration for low profile shallow speakers of the present invention. While the illustrated low profile speaker in FIG. 6 is similar to that of FIG. 2, the first cooling configuration shown here is compatible with all of the embodiments of the present invention that utilize motor 7. In this view, motor 7 is shown having magnets 49 sandwiched between top plate 53 and Tyoke 51 that extends from beneath magnets 49 and up through the center of the speaker with the top of Tyoke 51 opposite top plate 53 creating air gap 11 between Tyoke 51 and the combination of magnets 49 and top plate 53. In the top end of the portion of Tyoke 51 that extends up through the center of the speaker there is a first group of holes 55 that open into the top of air gap 11 (shown here opposite voice coil 15). Also, in the lower portion of Tyoke 51 there is a second group of holes 57 between the bottom of air gap 11 to the outside of frame 1. When voice coil 15 is powered and bobbin 17 moves in a downstroke, air is forced downward from beneath dust cover 35' through the center of Tyoke 51 as well as through holes 55 into air gap 11, around voice coil 15 and out through holes 57 to the outside frame 1 thus force cooling voice coil 15 and the other components of motor 7. This forced cooling configuration can be used with all of the embodiments of the present invention that include motor 7 whether or not the dust cover is attached to the top of bobbin 17 since in all of those embodiments the dust cover is attached to the top of the cone and the inner edge of the cone is attached to the side of bobbin 17 with the only opening into the center of the speaker being through the center of Tyoke 51 from the bottom of the speaker.

FIG. 6 also includes an optional second spider 28' connected between downward extension 27 and the top outer edge of motor 7. Optional second spider 28' could be included in all of the various embodiments of the current invention.

Figure 7A:
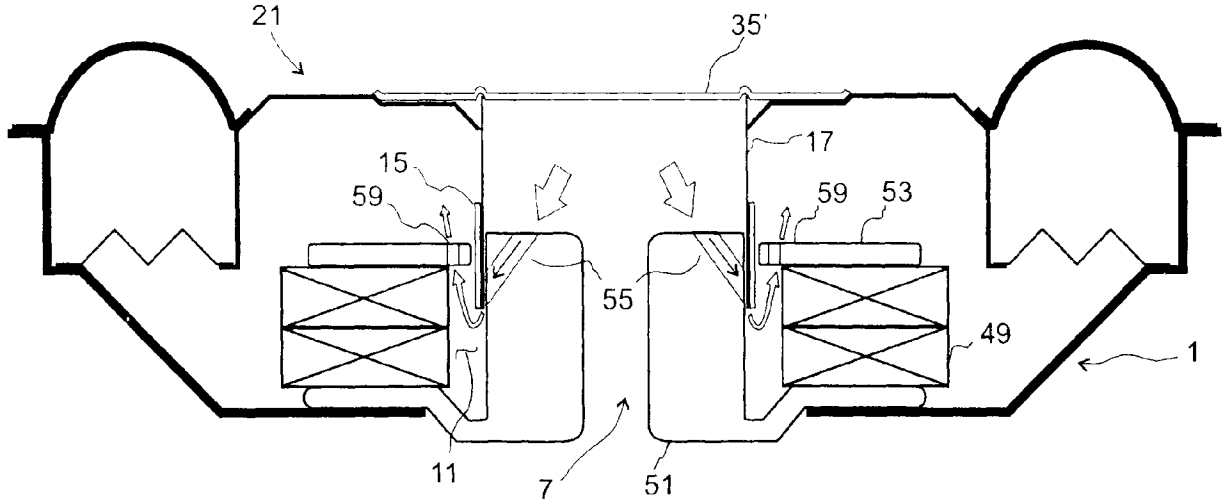
FIG. 7A is a cross-sectional center slice of a low profile shallow speaker of the present invention that is similar to that of FIG. 6 with a second motor cooling configuration.

FIG. 7A is similar to FIG. 6 with the same speaker and motor configuration without holes 57 in the bottom of Tyoke 51. In this second cooling configuration for all low profile shallow speaker embodiments that include motor 7, in addition to holes 55 through the top of Tyoke 51 into air gap 11, there is a group of holes 59 through top plate 53 between air gap 11 and beneath cone 21. In this configuration when voice coil 15 is powered and bobbin 17 moves in a downstroke, air is forced downward from beneath dust cover 35' through the center of Tyoke 51 as well as holes 55 into air gap 11, around voice coil 15 and out through holes 59 in top plate 53 into the space beneath cone 21 and out through holes (not shown) in frame 1, thus force cooling voice coil 15 and the other components of motor 7. This forced cooling configuration can be used with all of the embodiments of the present invention that include motor 7 whether or not the dust cover is attached to the top of bobbin 17 since in all of those embodiments the dust cover is attached to the top of the cone and the inner edge of the cone is attached to the side of bobbin 17 with the only opening into the center of the speaker being through the center of Tyoke 51 from the bottom of the speaker.

Figure 7B:
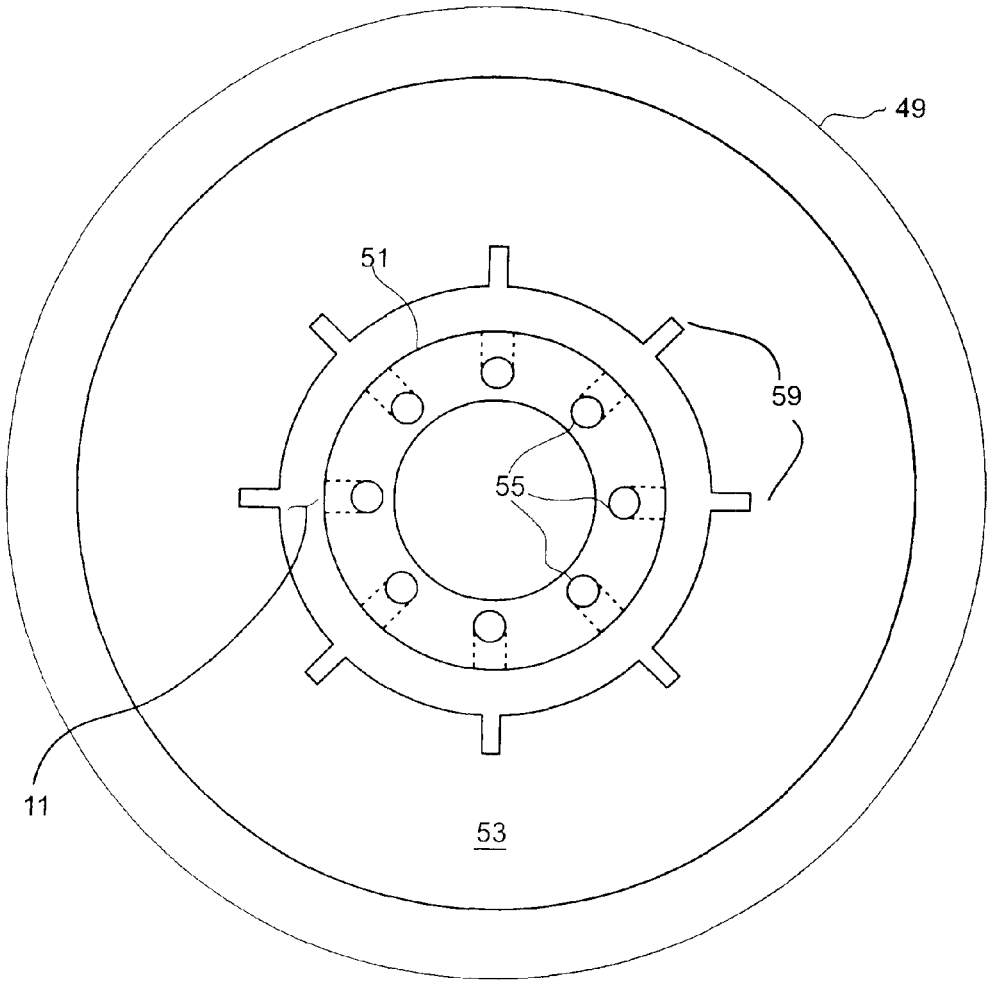
FIG. 7B is a top view of the motor of FIG. 7A assembled to illustrate the motor cooling configuration of FIG. 7A.

FIG. 7B is a top view of motor 7 of FIG. 7A assembled to illustrate the motor cooling configuration of FIG. 7A. Top plate 53 is shown center on magnet 49 with the center hollow pole of Tyoke 51 extending through the center hole in each of magnet 49 and top plate 53. Between the outer edge of Tyoke 51 and the inner edge of top plate 53 is the entrance to air gap 11 that receives the second end of the bobbin. Surrounding the inner hole of Tyoke 51 are cooling holes 55 in the top of Tyoke 51 that extend diagonally downward (denoted by dashed lines) to the outer side of Tyoke 51 opening into the top of air gap 11. Around the inner edge of top plate 53 there is a plurality of holes or slots 59.

An added benefit of the inclusion of holes 55 in the top of Tyoke 51 and holes or slots 59 in top plate 53 is that they reduce the formation of eddy currents that rotate in the magnetic gap. This is beneficial in that eddy current losses are a major problem in speaker designs. As the voice coil and bobbin move downward and upward in an electromagnetic relationship, that develops eddy currents that flow in the top plate of the electromagnetic motor. Those currents oppose the motion of the voice coil in the gap and cause the amount of energy to move the cone/voice coil to be greater to receive the same response from the speaker. The inclusion of holes or slots 59 in top plate 53 reduce the eddy current effect and thus improve the efficiency of the speaker.

Figure 7C:
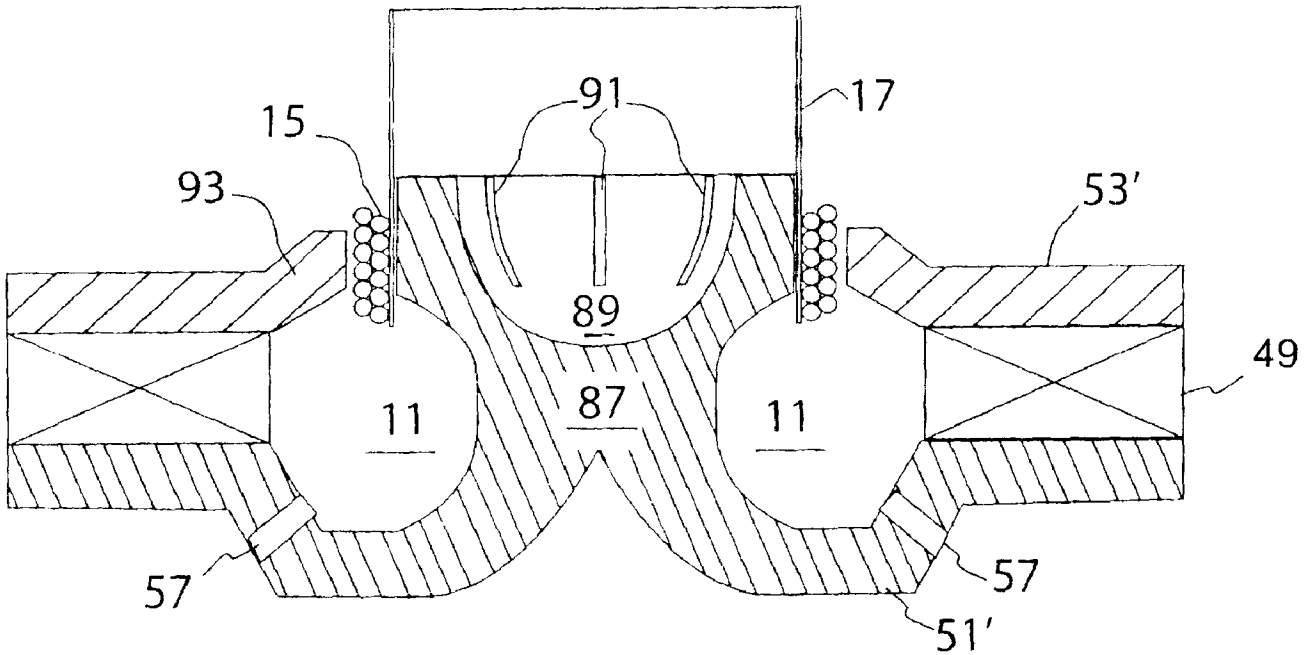
FIG. 7C is a center cross-section of an alternative motor assembly with a Tyoke having a solid center pole and cooling slots therein and in the inner edge of the top plate.
Figure 7D:
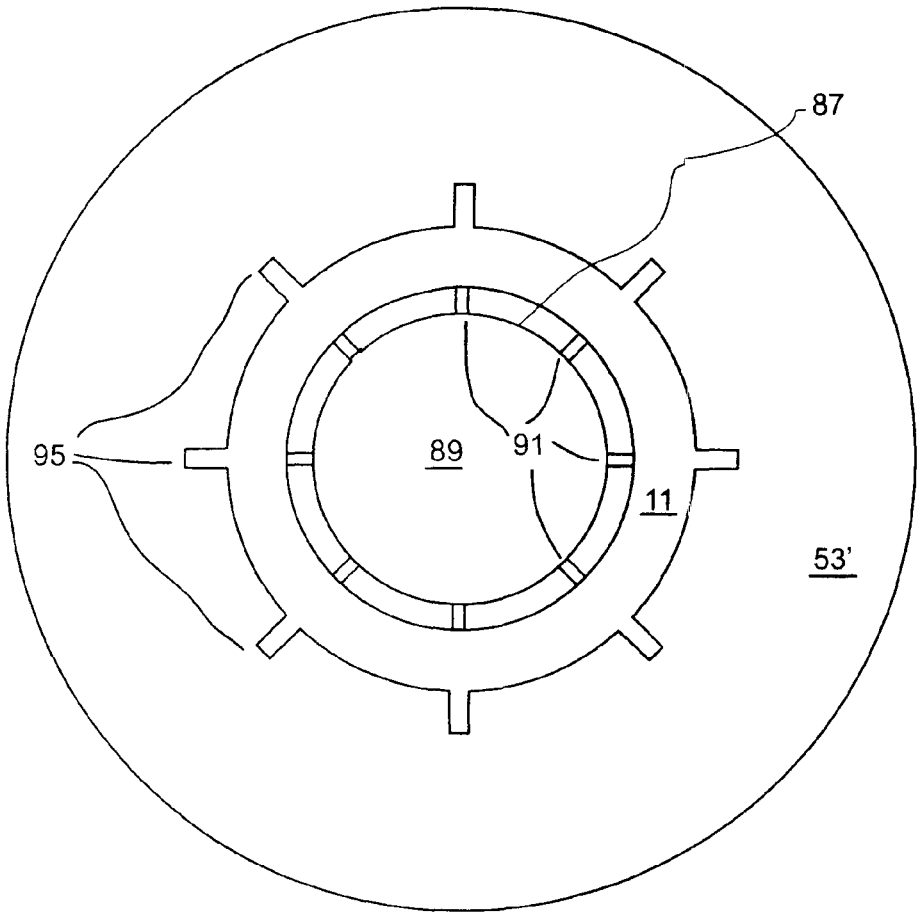
FIG. 7D is a top view of the alternative motor assemble of FIG. 7C.

FIGS. 7C and 7D illustrate an alternative structure of the motor assembly that incorporates the second cooling configurations of FIGS. 7A and 7B. FIG. 7C is a center cross section of motor 7' having a Tyoke 51' with a solid center pole 87 having a cup shaped top section 89. Magnet 49 is affixed to the outward extending flange of Tyoke 51' with top plate 53' affixed to the top of magnet 49. Top plate 53' is shown with an upward sloping inner end 93 having the inner edge thereof spaced apart from the outer surface of cup shaped top section 89 of Tyoke 51' to permit bobbin 17 and voice coil 15 to pass therebetween and extend into air gap 11. Additionally, the cup shaped top section 89 of Tyoke 51' has a plurality of center pole cooling slots 91 extending vertically downward therethrough from the top edge thereof that open opposite the inner surface of bobbin 17. Similarly, upward sloping inner end 93 of top plate 53' includes a plurality of radially extending top plate cooling slots 95 opposite void coil 15 and above air gap 11. The combination of cooling slots 91 and 95 provide cooling of voice coil 15 as do side middle Tyoke holes 55 and top plate holes 59 discussed above in relation to FIG. 7A. This alternative structure of the motor has the added advantage of that the entire volume of air beneath the dust cap is forced in and out of the combination of slots 91 and 95 thus improving cooling over the design of the design of FIGS. 7A and B. Also, in the lower portion of Tyoke 51 of FIG. 7C there is an optional second group of holes 57 between the bottom of air gap 11 to the outside of frame 1 that operate as described above in the discussion of FIG. 6.

Figure 8A:
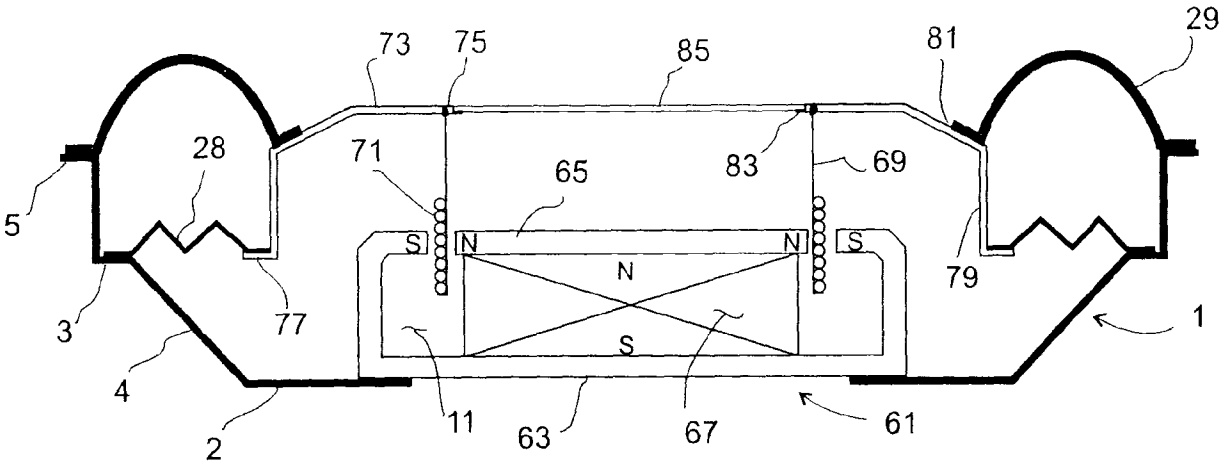
FIG. 8A is a cross-sectional center slice of a sixth embodiment low profile speaker of the present invention with a flatter motor with the diameter of the magnet smaller than the diameter of the bobbin.

FIG. 8A is a cross-sectional center slice of a sixth embodiment low profile speaker of the present invention. Included is a low profile frame 1, as in the previous figures having an interior bottom surface 2 with a side portion 4 extending upward from, and surrounding, the interior bottom surface. Side portion 4 terminates in an exterior edge 5 of a uniform height above the interior bottom surface 2 with the exterior edge 5 defining an opening into frame 1 having a selected size and shape. Side portion 4 also includes an interior side mounting point 3 therearound a fixed distance between the interior bottom surface 2 and the exterior edge 5.

The speaker of FIG. 8A also includes a flat motor 61 connected to the interior of bottom surface 2 of frame 1. Flat motor 61 includes a bottom, low height, elongated substantially "U" shaped, ferro magnetic plate 63 centered on interior bottom surface 2 of frame 1. The bottom of the "U" is flat, the sides of the "U" extend upward substantially perpendicularly from the bottom and the top edge of the sides turn inward forming a small lip that is parallel to the flat bottom of the "U". Centered within the "U" of bottom plate 63 is a magnet 67 that has a diameter that is smaller than the opening in the top of the "U" formed by the top edge lip of the bottom plate 63. Additionally, the height of magnet 67 is substantially equal to the internal height of the "U" formed between the inner surface of the bottom of the "U" and the inside surface of the lip at the top of the "U". Flat motor 61 further includes a ferro magnetic, flat top plate 65 that is centered on top of magnet 67 between the ends of the top lip of the "U" of bottom plate 63. The diameter of top plate 65 is shown as slightly larger than the diameter of magnet 67 leaving a circular opening between the ends of the lip of the "U" of bottom plate 63 and the outer edge of top plate 65 that provides access to the inner gap 11 within "U" shaped bottom plate formed between the outer edge of magnet 67 and the inner surface of the sides of the "U". Flat motor 61 also includes a bobbin 69 with a voice coil 71 wound on a first end thereon extending into air gap 11 through the circular opening between top plate 65 and the lip of the "U" of bottom plate 63, and a second end that extends out of air gap 11. Additionally, it can be seen that motor 61 has a height that is less than the overall height of frame 1.

The configuration of FIG. 8A permits the use of a ceramic magnet with the diameter of magnet 67 being smaller than the diameter of bobbin 69, which is the opposite of the configurations of FIGS. 1-7. The use of larger diameter bobbin 69 provides more anti-wobble protection for the bobbin than in the speakers in the configurations of FIGS. 1-7 where the bobbin 17 is within magnets 49 and the frames are the same size.

The embodiment of FIG. 8A also includes a cone 73 having an outer edge 77 and an inner edge 75, and a top surface and a bottom surface, with the inner edge 75 defining a centrally located hole having a diameter that is smaller than the diameter of bobbin 69 with the second end of bobbin 69 attached to the bottom surface of cone 73 spaced back from inner edge 75. From inner edge 75, cone 73 radiates outward a first selected distance at which point a downward extension 79 is formed with the end thereof being outer edge 77 of cone 73. The end of downward extension 79 is opposite interior side mounting point 3 of frame 1 with an inner suspension (shown here as a spider) 28 interconnecting interior side mounting point 3 with the end of downward extension 79. In this view it can be seen that the end of downward extension 79 defines a second size and shape that is smaller than the first size and shape defined by exterior edge 5 of frame 1. For purposes of discussion here the first and second shapes will each be referred to as a circle, however other shapes could be used, e.g., an oval.

Additionally, an outer suspension (shown here as a surround) 29 interconnects the exterior edge 5 of frame 1 with the top surface of cone 73 at point 81 that is substantially above downward extension 79. Cone 73 is also shown having a portion of the top surface that is higher than inner edge 75 thereof and higher than the top end of bobbin 69. A dust cover 85 that is sized and shaped to span bobbin 69 above the top end thereof with an outer edge affixed to a mounting lip 83 of the higher portion of the surface of the inner edge 75 of cone 73 is also shown. In this configuration it can be seen that inner suspension 28 and outer suspension 29 each span substantially the same length gap.

The design of FIG. 8A allows the use of a larger, lower cost magnet than as in the previously discussed embodiments and a larger diameter bobbin and voice coil that encircles the entire magnet. The use of a larger diameter bobbin and voice coil also allows the greater area of the bobbin to better conduct heat away from the voice coil and dissipate the heat more readily increasing thermal stability of the speaker. Additionally the greater diameter of the bobbin makes the speaker more stable and minimizes wobble of the bobbin more than in the earlier discussed embodiments of the present invention.

Figure 8B:
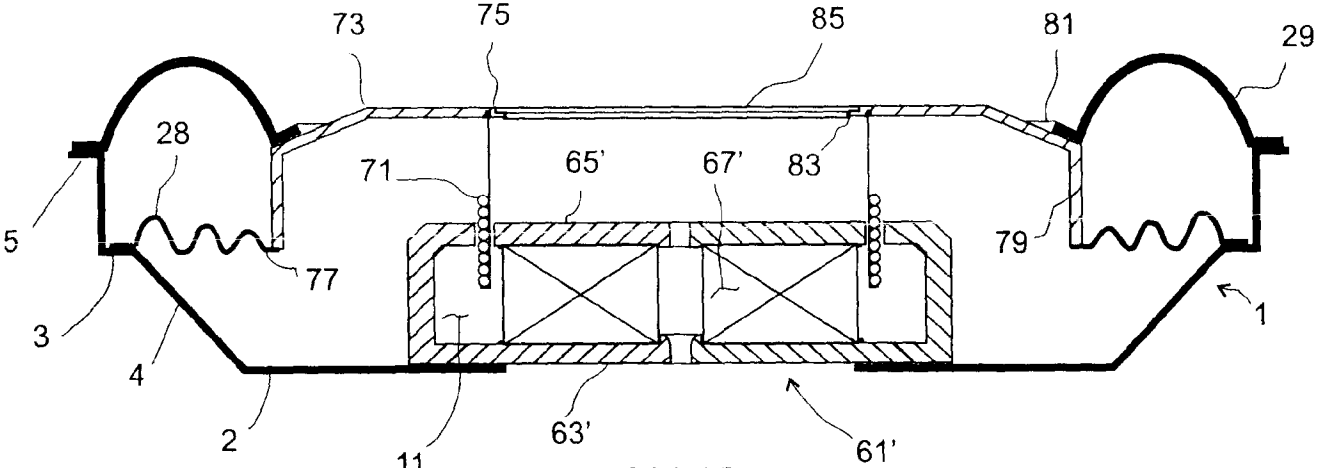
FIG. 8B is a cross-sectional center slice of a modified sixth embodiment low profile speaker of the present invention as shown in FIG. 8A with the magnet and top and bottom plates having a central hole therethrough.

FIG. 8B shows a low profile speaker that is the same as that of FIG. 8A with one change. In FIG. 8B motor 61' has a central hole therethrough with the central holes in bottom "U" shaped plate 63', flat top plate 65' and magnet 67' substantially aligned with each other to provide an air cooling path that offers pressure relief for air that is trapped under the dust cover and cone. Additionally, the center hole in the motor components offers an easy centering guide for assembly of the top and bottom plates with the magnet. The hole provides for an opening that allows the designer to make a centering roll in the middle.

While FIGS. 8A and 8B each illustrate a low profile speaker with a standard sized surround 29. An oversized surround 29' as shown in FIGS. 4 and 5 could be substituted for surround 29 in the speakers of FIGS. 8A and 8B.

Figure 8C:
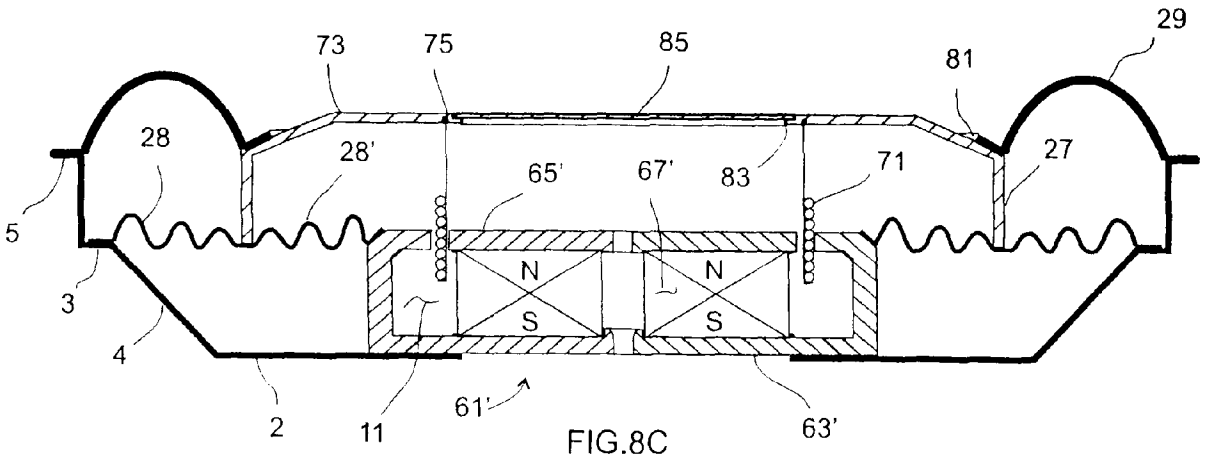
FIG. 8C is a cross-sectional center slice of a further modified sixth embodiment low profile speaker of the present invention as shown in FIG. 8B with a double spider extending between the frame and the top of the motor.

FIG. 8C shows a low profile speaker that is the same as that of FIG. 8B with the addition of an optional second spider 28' connected between downward extension 79 and the top outer edge of motor 61'. The inclusion of optional second spider 28' adds more anti-wobble control.

Figure 8D:
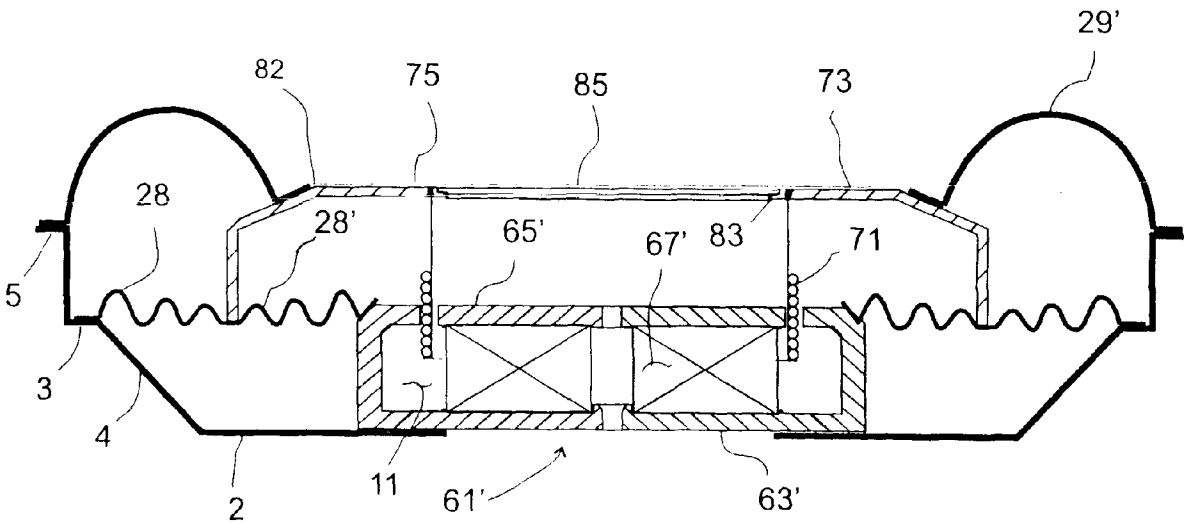
FIG. 8D is a cross-sectional center slice of another modified sixth embodiment low profile speaker of the present invention as shown in FIG. 8C with the magnet and top and bottom plates having a central hole therethrough.

FIG. 8D shows a low profile speaker that is the same as that of FIG. 8C with surround 29 replaced with oversized outer OSS surround 29' with the inner edge thereof attached to cone 73 at connection point 82 near the top flat portion of cone 73 and closer to inner edge 75 than connection point 81. In this configuration it can be seen that oversized surround 29' spans a longer distance than that spanned by spider 28. As discussed above, the inclusion of an oversized outer OSS surround 29' offers reduced resistance and change for the development of dimples during long bobbin down strokes.

While various features are shown in various of the illustrated embodiments, those features can be mixed and matched with each other to create alternative speaker designs to those included here for illustrative purposes. The present invention is intended to include any and all of those alternative designs as well as those illustrated herein. Thus one should not consider that any feature needs to be fixed only with the other features that are shown in the same illustrated embodiment where that feature was introduced and discussed.

What is claimed is:

1. An audio speaker comprising:

a frame having an interior bottom surface with a side portion extending upward from, and surrounding, said interior bottom surface, said side portion terminating in an exterior edge of a uniform first height above said interior bottom surface with said exterior edge defining an opening into the frame having a first size and shape, and an interior mounting point of an inner surface of said side portion there around a first selected distance between said interior bottom surface and said exterior edge;

a motor including a magnet assembly with an air gap formed therein mounted in direct contact to the interior bottom surface of the frame and a bobbin having an outer surface of a first diameter with a first end with a voice coil wound thereon located in said air gap, and a second end extending out of said air gap wherein said magnet assembly has a second height that is less than said first height, said motor has a second size and shape that is smaller than said first size and shape;

a cone having an outer edge and an inner edge, and a top surface and a bottom surface, with said inner edge defining a centrally located hole sized to fit around and attach to said outer surface of said bobbin at or below the second end of the bobbin, from the inner edge the cone radiates outward a second selected distance where said cone turns downward forming a downward extension pointing toward the interior bottom surface of the frame with the outer edge of the cone at the end of the downward extension with said outer edge of the cone defining a third size of a shape similar to said first shape, and said third size and shape is smaller than said first size and shape of the frame and larger than said second size and shape of the motor;

a first flexible suspension connected between said interior mounting point of the frame and a selected connection point on said downward extension of the cone; and a second flexible suspension connected between said exterior edge of the frame and the top surface of the cone at a third selected distance from the inner edge of the cone wherein said third selected distance is less than or equal to said second selected distance.

2. The audio speaker as in claim 1 wherein said selected connection point on said downward extension is opposite said interior mounting point of the frame when the voice coil is not energized.

3. The audio speaker as in claim 1 wherein said selected connection point on said downward extension is on or near said outer edge of said cone.

4. The audio speaker as in claim 2 wherein said outer edge of said cone is a fourth selected distance below said selected connection point on said downward extension with the overall length of the downward extension being long enough so that the outer edge of the cone strikes the interior bottom surface of the frame before said first end of the bobbin strikes a bottom of said air gap in the motor on a downstroke to protect the bobbin from possible damage.

5. The audio speaker as in claim 1:

wherein a selected portion of the top surface of the cone is higher than the inner edge of the cone; and the audio speaker further comprises a dust cover that is sized and shaped to span the bobbin with a bottom surface of the dust cover affixed to the selected portion of the top surface of the cone.

6. The audio speaker as in claim 5 wherein said dust cover is attached to said second end of the bobbin.

7. The audio speaker as in claim 5 wherein said selected portion of the top surface of the cone includes a first plateau closest to said inner edge of the cone to receive the bottom surface of the dust cover and a second plateau farthest from the inner edge of the cone that is higher than the first plateau with an edge formed between the first and second plateaus being a centering edge for placement of the dust cover on said first plateau with an edge of said dust cover in a close position relative to the edge between the first and second plateaus of the top surface of the cone.

8. The audio speaker as in claim 5 wherein said selected portion of the top surface of the cone includes a raised centering bead encircling and spaced apart from said inner edge of the cone for centering of the dust cover with and edge of said dust cover in a close position relative to said raised centering bead.

9. The audio speaker as in claim 8 wherein said downward extension is between an outer most extent of said motor relative to said interior bottom surface of the frame and said side portion of the frame.

10. The audio speaker as in claim 1 said first flexible suspension connected said downward extension at said outer edge said cone.

11. The audio speaker as in claim 1 wherein said second flexible suspension is connected to the top surface of the cone substantially at the point where the cone turns downward to form the downward extension of the cone.

12. The audio speaker as in claim 1 wherein said second flexible suspension spans a space from said exterior edge of said frame to a point on the top surface of said cone inward of the point where said cone turns downward to form said downward extension of the cone.

13. The audio speaker as in claim 1 further including a third flexible suspension connected between said downward extension of said cone and a top surface of said motor.

14. The audio speaker as in claim 1 wherein:

said speaker further includes a dust cover sized and shaped to span the bobbin with the bottom thereof affixed to the top surface of the cone; and said magnet assembly of said motor includes:

a ferro magnetic Tyoke with an upward extending center pole portion having an outward extending flange from the bottom thereof, said center pole portion having a third diameter that is smaller than said first diameter of the bobbin and an outer edge of said outward extending flange has a fourth diameter that is larger than said first diameter and smaller than said second diameter;

a flat doughnut shaped magnet having a circular center hole having a fourth diameter that is larger than said first diameter of the bobbin with said magnet affixed to said outward extending flange and centered around said center pole of said Tyoke providing said air gap between said magnet and said center pole; and a ferro magnetic doughnut shaped top plate having a circular center hole having a fifth diameter that is larger than said first diameter of said bobbin and smaller than said fourth diameter of the center hole of the magnet with said top plate affixed to said magnet and centered around said center pole of said Tyoke;

wherein said Tyoke has a plurality of air passages defined between a top and outer side thereof opening into said air gap and a plurality of air passages through said outward extending flange between a bottom of said air gap and a bottom of said speaker so that on the downstroke of the bobbin air below the dust cover is forced through said air passages in the top of the Tyoke into the air gap and out through the air passages in the outward extending flange to cool the voice coil as air passes through the air gap.

15. The audio speaker as in claim 1 wherein:

said speaker further includes a dust cover sized and shaped to span the bobbin with the bottom thereof affixed to the top surface of the cone; and said magnet assembly of said motor includes:

a ferro magnetic Tyoke with an upward extending center pole portion having an outward extending flange from the bottom thereof, said center pole portion having a third diameter that is smaller than said first diameter of the bobbin and an outer edge of said outward extending flange has a fourth diameter that is larger than said first diameter and smaller than said second diameter;

a flat doughnut shaped magnet having a circular center hole having a fourth diameter that is larger than said first diameter of the bobbin with said magnet affixed to said outward extending flange and centered around said center pole of said Tyoke providing said air gap between said magnet and said center pole; and a ferro magnetic doughnut shaped top plate having a circular center hole having a fifth diameter that is larger than said first diameter of said bobbin and smaller than said fourth diameter with said top plate affixed to said magnet and centered around said center pole of said Tyoke;

wherein said Tyoke has a plurality of air passages defined between a top and outer side thereof opening into said air gap and said top plate has a plurality of air passages defined through an inner edge thereof in communication with said air gap so that on the downstroke of the bobbin air below the dust cover is forced through said air passages in the top of the Tyoke into the air gap and out through the air passages in the top plate to cool the voice coil and bobbin as air passes through the air gap.

16. The audio speaker as in claim 15 wherein said center pole of said Tyoke is solid with a cup shape in a top surface thereof with said plurality of air passages being in the shape of slots through a top portion of said cup shape with this configuration causing the entire volume of air beneath the dust cap to be forced in and out of the combination of the slots in the Tyoke center pole and the top plate to cool the voice coil and bobbin.

17. The audio speaker as in claim 16 wherein said top plate has an upward sloping inner edge spaced apart from the outer surface of cup shape of the center pole of the Tyoke.

18. The audio speaker as in claim 15 wherein said air passages in said Tyoke and said top plate reduce the formation of eddy currents that rotate in the magnetic gap and thus reduce eddy current losses that otherwise oppose the motion of the voice coil in the gap and cause the amount of energy to move the cone and voice coil to be greater to receive the same response from the speaker.

19. The audio speaker as in claim 1 wherein:

said motor is circular with flat top and bottom surfaces wherein said magnet assembly includes:

a ferro magnetic circular enclosure having a third diameter that is larger than said first diameter of the outer surface of the bobbin and smaller than said second diameter of said downward extension with a cross-section that is substantially "U" shaped with a flat bottom, sides that extend upward substantially perpendicularly from the bottom and a top edge that turns inward forming a small lip that is parallel to the flat bottom forming an opening into said enclosure with the inner edge of said lip having a fourth diameter that is slightly smaller than said third diameter of the enclosure and slightly larger than said first diameter of said bobbin;

a flat circular magnet centrally mounted within said enclosure having a fifth diameter that is smaller than said first diameter of the bobbin and a height that is substantially equal to the internal height of the enclosure formed between the inner surface of the bottom of the enclosure and the inside surface of the lip forming said air gap between the magnet and the vertical sides of the enclosure; and a ferro magnetic circular flat top plate centered on top the magnet between the ends of the lip of enclosure having a sixth diameter that is smaller than the first diameter of the bobbin and greater than or equal to the fifth diameter of the magnet with a space between the lip of the enclosure and the top plate disposed to receive said first end of the bobbin and voice coil wound thereon.

20. The audio speaker as in claim 19 wherein:

said inner edge of said cone terminates in a short mounting lip having an upward facing top side; and said speaker further includes a flat dust cover with a bottom and edge sized and shaped fit on said mounting lip of the cone.

21. The audio speaker as in claim 19 wherein each of said ferro magnetic circular enclosure, flat circular magnet and ferro magnetic circular flat top plate has a hole defined centrally therethrough that provides an easy centering guide for assembly of the motor.

* * * * *